US005381718A

United States Patent [19]

Wasser

[11] Patent Number: 5,381,718

[45] Date of Patent: Jan. 17, 1995

[54] PROCESS FOR MAGNETICALLY SEATING A TONE HOLE PAD

[75] Inventor: Steven A. Wasser, Wellesley, Mass.

[73] Assignee: Verne Q. Powell Flutes, Inc., Waltham, Mass.

[21] Appl. No.: 143,355

[22] Filed: Oct. 26, 1993

Related U.S. Application Data

[63] Continuation-in-part of Ser. No. 936,358, Aug. 25, 1992, Pat. No. 5,297,466, which is a continuation-in-part of Ser. No. 877,906, May 1, 1992, Pat. No. 5,339,719.

[51] Int. Cl.[6] ..... G10D 7/08

[52] U.S. Cl. ..... 84/385 P

[58] Field of Search ..... 84/385 P, 380 R, 171

[56] References Cited

U.S. PATENT DOCUMENTS

| | | | |
|---|---|---|---|
| 1,728,553 | 9/1929 | Klinger | 84/385 P |
| 1,747,113 | 2/1930 | Gulick | 84/385 P |
| 1,830,025 | 11/1931 | Gulick | 84/385 P |
| 2,534,660 | 12/1950 | Collis | 84/385 P |
| 3,623,391 | 11/1971 | Nagao | 84/385 P |
| 4,342,244 | 8/1982 | Perkins | 84/171 |
| 5,297,466 | 3/1994 | Wasser | 84/385 P |

*Primary Examiner*—Michael L. Gellner
*Assistant Examiner*—Cassandra Spyrou
*Attorney, Agent, or Firm*—Joseph S. Iandiorio

[57] ABSTRACT

A process for evenly seating a woodwind instrument tone hole sealing pad in the pad cup includes placing the pad on the tone hole rim, placing an at least partially magnetic element between the pad and cup; placing a solidifiable substance between the element and cup, and applying a magnetic force to the element to move the pad against the tone hole rim; the pad can be secured to the cup using a screw or other fastener or a solidifiable substance introduced before, during or after applying the magnetic force.

23 Claims, 2 Drawing Sheets

PROCESS FOR MAGNETICALLY SEATING A TONE HOLE PAD

RELATED APPLICATIONS

This application is a continuation in part of Ser. No. 07/936,358, filed Aug. 25, 1992, now U.S. Pat. No. 5,297,466 which is a continuation-in-part of application Ser. No. 07/877,906 filed May 1, 1992 now U.S. Pat. No. 5,339,719.

FIELD OF INVENTION

This invention relates to an improved process for magnetically evenly seating a woodwind instrument tone hole sealing pad in the pad cup so that the pad properly seals on the tone hole rim in use.

BACKGROUND OF INVENTION

In order for a woodwind instrument to have accurate sound, it is critical that the tone hole sealing pad make a complete seal flat against the tone hole rim. Since the tone hole rims are almost never perfectly flat, the pads are almost never perfectly flat, and the cup that holds the pad is almost never perfectly flat, the pads must be installed in the cup using shims behind the pad in order to get as close to a sealing fit as possible. The installation is made more difficult by the fact that the cup approaches the tone hole from an angle, making this shimming more guess work than science.

There have been a number of techniques developed in attempts to provide relatively easy installation of pads that properly seal around the entire circumference of the tone hole rim. One method contemplates floating the pads into place on a liquid placed in the cup, which then hardens to serve as a permanent shim between the cup and the pad. In this process, while the pad is floating on the liquid, the installer pushes the pad against the tone hole rim by moving the cup down towards the rim. Ideally, the pad will seat flat against the rim and the liquid will harden, securing the pad in the position necessary in the cup to provide a flat fit of the pad against the rim. Typically, shellac is used as the liquid for floating the pad; the shellac is melted by the application of heat to the cup. Various other adhesives have also been used.

This floating technique suffers from a number of problems. The larger pads for the woodwind instruments having larger tone holes are inherently more flexible than the smaller pads and thus are even more likely not to be flat. Since the traditional floating process relies primarily on pads being flat and rigid, the process does not work well for these large pads. Further, the pad installer must very carefully push the cup against the tone hole rim while seating the pad in the floating process, since there is really no effective way to pull the pad out of the cup once it is pushed into the cup. Sometimes the installer can stick a pin in the side of the pad and lever it back out of the cup, but this procedure can damage the pad skin, is imprecise, and can sometimes leave air bubbles behind the pad which allow the pad to collapse at this point in use. One method that has been developed to move the pad around in the cup while it is being installed in such a manner is to place a shim or slick between the pad and the cup under one section of the pad in order to compensate for some imprecision in the floating process. However, this requires that the operator perform educated guesswork, which is fraught with problems and also requires an experienced and thus expensive installer.

For pads that are held in a cup with a screw and a washer, the pads are typically shimmed with extremely thin pieces of paper placed between the pad and the cup to push the pad forward so that it lies flat against the tone hole rim. This installation is typically accomplished by the installer first applying a single paper shim cut in a desired shape to match as closely as possible the pad to the rim. Then, the pad is pressed against the rim using the instrument keys. The installer can then use a feeler gauge or a light source placed inside the instrument tube to find gaps between the pad and the rim. The installer identifies and marks the location of the gaps, removes the key from the instrument, removes the pad from the cup, and then adds one or more shims to make up for the gaps. The pad is then placed back into the cup, the key is reassembled onto the instrument, and the pad closure is tested again with a feeler gauge or light source. The shimming process is repeated as often as necessary to accomplish the desired seating.

This process suffers from the drawbacks that it is time consuming and depends on the judgment of the installer regarding the location and thickness of paper shims. Since this judgment is experiential, the installer must be skilled, and the process is therefore expensive. Further, the cup surfaces typically are not flat. Accordingly, over time the paper or plastic shims can collapse into the curve of the cup, destroying the flatness that is accomplished with the shims. Another problem with this installation technique is that it requires frequent replacement of the metal screws, washers and/or bushing which hold the pad in place. Since it is nearly impossible to accomplish such replacement in the same way twice, the installer may conclude that a pad is leaking because of improper shimming when in fact the placement or tension of the metal pad holder has altered the position of the pad. Finally, the metal pad holders amplify the noise of the pad striking the tone hole rim and are thus undesirable in good quality instruments.

A third pad installation technique for felt pads contemplates securing the pads in the cups using metal or plastic pad holders that are clamped in place. Steam is then circulated through the body of the instrument to set the tone hole rim impression in the pad. However, this setting is impermanent and thus the pad will have a tendency to return at least partially to its original position, causing the pads to leak. Further, these felt pads are thick and fluffy thus have a spongy feel to the player which is undesirable because the player does not know exactly when the pad is in contact with the tone hole rim. Additionally, pads which can take a deep impression of the tone hole rim create more surface on which the pad can stick to the tone hole rim, making play difficult. The metal pad holders amplify the noise of the pad striking the tone hole rim, making them undesirable. Finally, since the technique requires steam, it cannot be used on instruments made of wood.

SUMMARY OF INVENTION

It is therefore an object of this invention to provide a pad installation technique that is extremely easy to use.

It is a further object of this invention to provide such a technique which insures that the pad is seated against the entire circumference of the tone hole rim.

It is a further object of this invention to provide such a technique which requires very little skill or experience and thus is relatively inexpensive to accomplish.

It is a further object of this invention to provide such a technique which is much faster than existing techniques and is thus less expensive.

It is a further object of this invention to provide such a technique which accomplishes a permanent relationship between the pad and the tone hole rim.

This invention results from the realization that a simple yet extremely effective pad installation technique may be accomplished by applying a downward magnetic force to a magnetic element which is in the pad or between the pad and the cup to properly seal the pad against the tone hole rim; the pad can be secured to the cup using a screw or other fastener or a solidifiable substance introduced before, during or after applying the magnetic force.

This invention may be accomplished in a process for evenly seating a woodwind instrument tone hole sealing pad in the pad cup. The process contemplates placing the pad on the tone hole rim, placing a magnetic element between the pad and cup, and applying a magnetic force to the pad to seat it on the tone hole rim. A solidifiable substance introduced before or after the application of the magnetic force may be used to position the pad in the cup while the pad is seated against the tone hole rim to permit the solidifiable substance to solidify while the magnetic force holds the pad in proper sealing position against the tone hole rim. Alternatively, the pad may be secured using a screw or other fastener and the pad has been properly seated by the magnetic force.

The pad is preferably positioned in the cup with a solidifiable substance such as a silicone compound or shellac. The solidified material is preferably remeltable, such as is the case with shellac or a hot-melt glue, to allow subsequent adjustments should they be necessary.

The magnetic force may be applied by attraction or repulsion, and may be accomplished with a permanent or electromagnet, and a magnetically-attractable material in, on or above the pad, for example a metal washer placed in or on top of the pad. Alternatively, the pad or the washer could be magnetic, and then seated with a magnetically-attractable material placed near the pad assembly.

The magnet may be permanent or an electromagnet. It may be placed within or outside of the instrument, close to but not touching the pad. A spacing or holding device may be employed to maintain the spacing during pad seating.

The pad assembly may include a pad and a magnetic or magnetically-attractable or repellable element in, coupled to or behind the pad. This allows the assembly to be seated using magnetic force applied, for example, by an external magnet. Or the element itself may contain or be a magnet which in combination with an external magnetic element exerts a magnetic force to move the pad against the tone hole rim either by magnetic attraction or repulsion.

DISCLOSURE OF PREFERRED EMBODIMENTS

Other objects, features and advantages will occur to those skilled in the art from the following description of a preferred embodiment and the accompanying drawings, in which.

This invention features a method for installing a woodwind instrument tone hole sealing pad contemplating placing a magnetically-attractable element behind, on or in a pad on the tone hole rim and applying a magnetic force to seat the pad against the rim. While the pad is seated on the rim by the magnetic force a solidifiable substance may be made to solidify to secure the pad in position or a screw or other fastening means may be used for that purpose.

Figure 1:
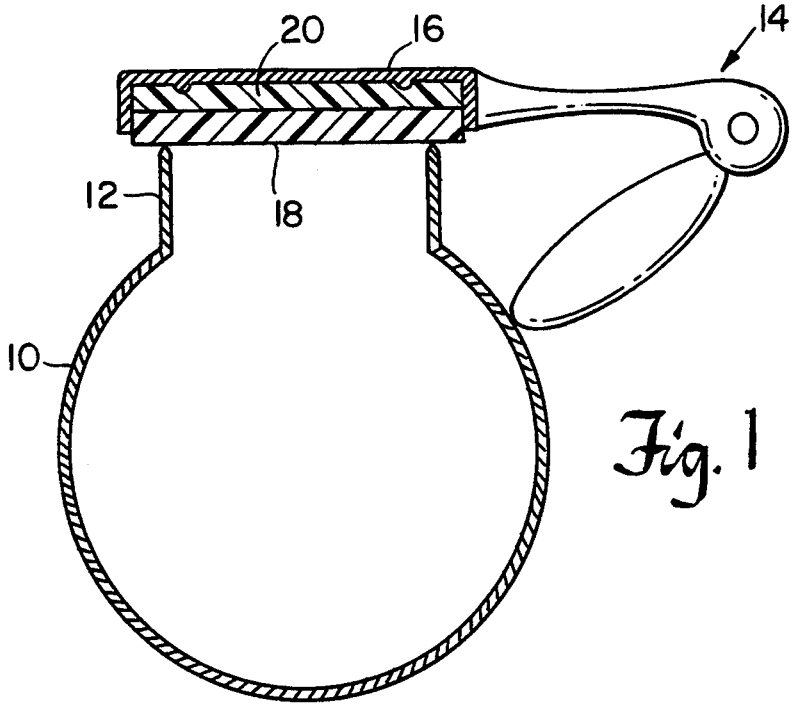
FIG. 1 is a cross sectional view of a flute with a tone hole sealing pad according to this invention installed by the method of this invention.

There is shown in FIG. 1 woodwind instrument such as flute 10 having a tone hole defined by tone hole rim 12. The tone hole is sealed with pad 18 held in cup 16 that is movable on and off of rim 12 by key assembly 14. Substance 20 which is preferably a hardenable liquid substance, is used to retain pad 18 in cup 16 in such a fashion that pad 18 seats flat around the entire circumference of the tone hole 12 and also so that pad 18 protrudes slightly from cup 16 as shown as is desired in quality woodwind instruments. Pad 18 may be any of the known pad types such as silicone, plastic materials, cork, and/or felt.

Figure 2A:
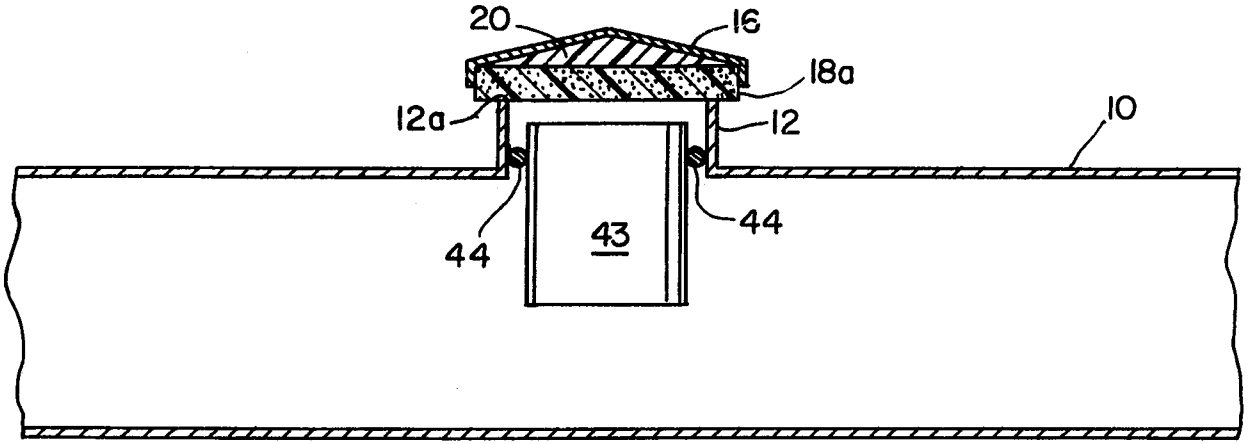
FIG. 2A is a partial cross sectional view of a tone hole sealing pad being installed in a woodwind instrument by the method of this invention.

One embodiment of this invention is shown in FIG. 2A. In this process one secures a magnet 43 in the tone hole below the tone hole rim 12*a*, and relies on the magnetic attraction between the pad 18 and the magnet to create the force to hold the pad against the tone hole rim. The pad is made at least partially magnetically attractable by using a metal washer within or on the pad. See FIG. 3. For pads which are molded or made from synthetic material, magnetic material can be added to the pad material during manufacture to provide an attractable pad. There is thus no direct contact between the pad and the force-producing magnet. The magnet can be held in the tone hole through use of an o-ring 44, a "carrying arbor", or other devices for removably holding the magnet near the pad. One advantage of this technique is that the instrument does not have to be held perpendicular to the force of gravity, and can be handled while the pad is floated into the cup. Alternatively, the pad could be made using a magnet and a piece of magnetic material could be placed in the instrument to attract the pad.

Figure 2B:
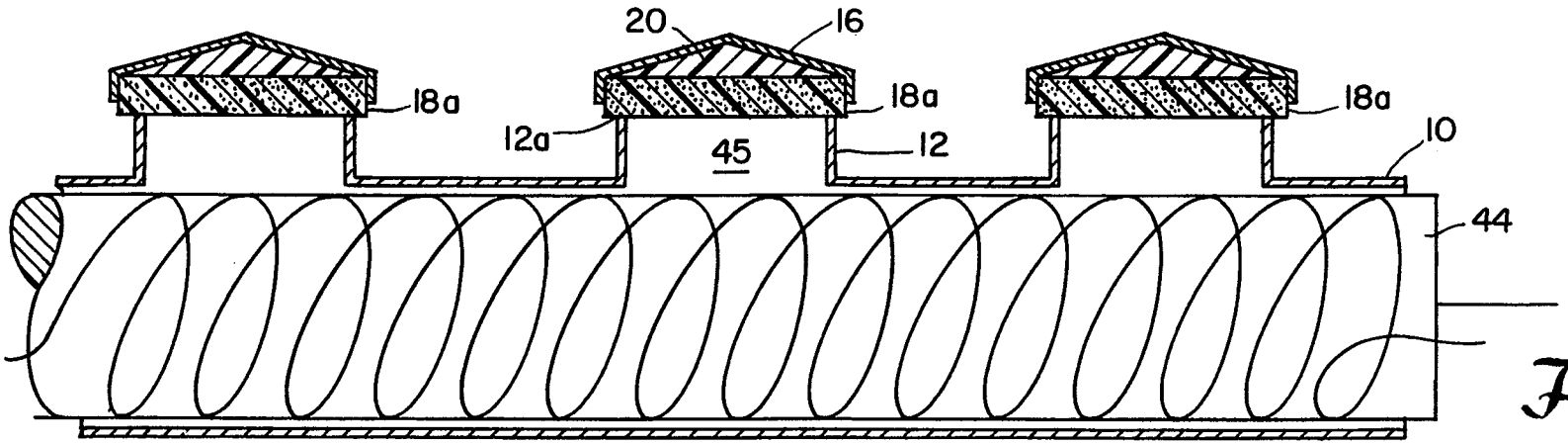
FIG. 2B is a partial cross sectional view of another means of applying the magnetic force to the pad during the installation method of this invention.

The method described above involves force-creating devices for each tone hole. Since there are sixteen or more tone holes on a typical flute, this can be cumbersome. An improvement on this is shown in FIG. 2B. One inserts a magnetic rod 44 into the entire body of the instrument 10 which is strong enough to exert force across the gap between the magnetic rod and the pad 18*a*. This magnetic force will pull all the pads 18*a* down against the tone hole rim 12*a* simultaneously. Each pad can then be floated into its cup 16 individually or all pads can be floated into place simultaneously. Ideally the magnetic rod will be an electromagnet so that the force can be varied or turned on and off, which will allow easy removal of the rod. Using this technique there is no need to disassemble the keys from the instrument to remove the force. It should be quick, neat, flexible, and accurate; it also requires little or no skill.

Assembly of the cup to the pad assembly is completed by adhering the pad into the cup while the pad is in position on the tone hole rim. Preferably, this adhesion is accomplished with a solidifiable substance or hardenable liquid material such as a hot melt glue, a silicone compound or shellac, for example. The material is preferably placed in the cup in a liquid or tacky form and then the cup is seated down onto the pad. After the material hardens, the magnetic force is removed.

The floating material is preferably a hot melt glue such as Jet Melt Adhesive Number 3792Q made by 3M Corp., St. Paul, Minn. This substance can be reliquified by the application of heat to allow the pads to be adjusted if necessary. The installer presses the cup with the floating material onto the pad until the pad protrudes the correct distance from the cup.

If the pad is made of a material like wool felt which is likely to swell and/or shrink over time, an impression of the tone hole rim can be created in the pads by steaming and clamping to minimize the chances of future leaks around the pad-rim seal.

Figure 3:
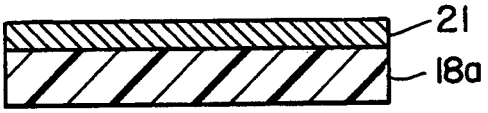
FIG. 3 is a cross sectional view of a pad design according to this invention.

FIG. 3 shows another embodiment of a pad assembly according to this invention. Pad 18*a* includes magnetic or magnetically-attractable material 21 to allow the application of magnetic force to seat pad 18*a* on a tone hole rim. The force could be attractive or repulsive. As described, the material can be in or on, or coupled to the pad to provide a magnetically seatable pad assembly.

Figure 4:
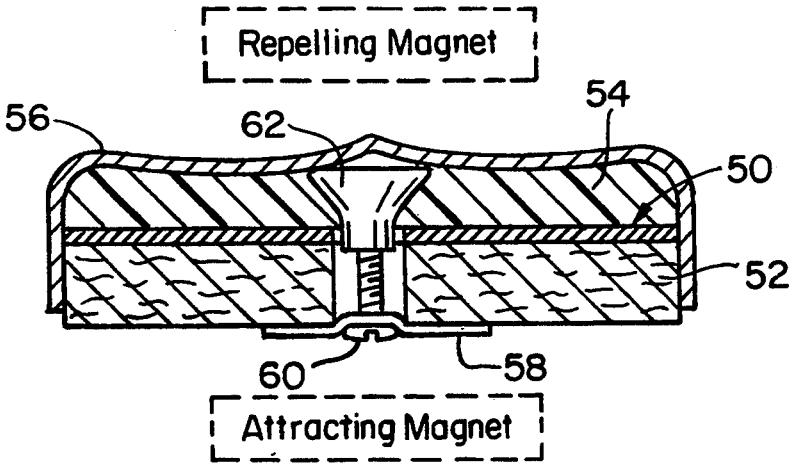
FIG. 4 is a cross-sectional view of a means of applying a magnetic force to a magnetic element behind and separate from the pad.

For example, a magnetic element such as steel washer 50, FIG. 4, which may be a magnetic material or a magnet, is disposed behind or above the pad 52 and a solidifiable material 54 is placed between element 50 and cup 56. A magnetic force is applied to draw element 50 downwardly against pad 52 to move pad 52 to seat against the tone hole rim evenly so that the solidifiable substance 54 can set up while holding pad 52 in the proper seating position. A conventional pad washer 58 is loosely held in place by pad screw 60 engaged with spud 62. The magnetic force applied can be either attractive or repulsive and can be established between an element which includes a magnet and an external magnetic member or between an element which is merely magnetic and an external magnet. Alternatively, the solidifiable material 54 may be omitted and the pad secured by a fastening means such as screw 60, washer 58 and spud 62 or both the soidifiable substance and some other fastening means could be used.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A process for magnetically, evenly seating a woodwind instrument tone hole sealing pad in a pad cup, comprising:

placing a pad on a tone hole rim;

placing an at least partially magnetic element between said pad and cup;

placing a solidifiable substance between said element and cup; and applying a magnetic force to said element to move said pad to seat on the tone hole rim.

2. The process of claim 1 in which applying a magnetic force includes positioning a magnet proximate said element.

3. The process of claim 2 in which positioning a magnet includes initially placing the magnet close to but not touching said element.

4. The process of claim 2 in which the magnet is a permanent magnet.

5. The process of claim 2 in which the magnet is an electromagnet.

6. The process of claim 1 in which the magnetic force is attractive.

7. The process of claim 1 in which the magnetic force is repulsive.

8. The process of claim 1 in which said element is a magnet and the magnetic force is applied with an external magnet.

9. The process of claim 1 in which said element is a magnet and the magnetic force is applied in combination with an external magnetic member.

10. A process for magnetically, evenly seating a woodwind instrument tone hole sealing pad in a pad cup, comprising:

placing a pad on a tone hole rim;

placing an at least partially magnetic element between said pad and cup; and applying a magnetic force to said element to move said pad to seat on the tone hole rim.

11. The process of claim 10 in which applying a magnetic force includes positioning a magnet proximate said element.

12. The process of claim 11 in which positioning a magnet includes initially placing the magnet close to but not touching said element.

13. The process of claim 11 in which the magnet is a permanent magnet.

14. The process of claim 11 in which the magnet is an electromagnet.

15. The process of claim 10 in which the magnetic force is attractive.

16. The process of claim 10 in which the magnetic force is repulsive.

17. The process of claim 10 in which said element is a magnet and the magnetic force is applied with an external magnet.

18. The process of claim 10 in which said element is a magnet and the magnetic force is applied in combination with an external magnetic member.

19. The process of claim 10 further including placing a solidifiable substance between said element and cup before, during or after the application of the magnetic force.

20. A process for magnetically, evenly seating a plurality of woodwind instrument tone hole sealing pads in a like plurality of pad cups, comprising:

placing each said pad on an associated tone hole rim;

placing an at least partially magnetic element between each said element and each said cup;

placing a solidifiable substance between each said element and each said cup; and applying a magnetic force to each said element to move each said pad to seat on said associated tone hole rim.

21. The process of claim 2 in which the magnet is positioned proximate said plurality of pads and said magnetic elements at the same time to seat said plurality of pads.

22. A process for magnetically, evenly seating a plurality of woodwind instrument tone hole sealing pads in a like plurality of pad cups, comprising:

placing each said pad on an associated tone hole rim;

placing an at least partially magnetic element between each said element and each said cup; and applying a magnetic force to each said element to move each said pad to seat on said associated tone hole rim.

23. The process of claim 22 in which the magnet is positioned proximate the plurality of pads and said elements at the same time to seat the plurality of pads.

* * * * *